US010826279B1

(12) United States Patent
Santana et al.

(10) Patent No.: US 10,826,279 B1
(45) Date of Patent: Nov. 3, 2020

(54) SPARK PLUG GROUND ELECTRODE CONFIGURATION

(71) Applicant: Federal-Mogul Ignition LLC, Southfield, MI (US)

(72) Inventors: Anthony Santana, South Lyon, MI (US); Andreas Zeh, Sonneberg (DE); Rene Trebbels, Erkelenz (DE); Sofian Oeij, Herzogenrath (DE); Kevin Miller, Ida, MI (US); John Burrows, Manchester (GB); Sam Roe, Manchester (GB)

(73) Assignee: Federal-Mogul Ignition LLC, Southfield, MI (US)

( * ) Notice: Subject to any disclaimer, the term of this patent is extended or adjusted under 35 U.S.C. 154(b) by 0 days.

(21) Appl. No.: 16/553,832

(22) Filed: Aug. 28, 2019

(51) Int. Cl.
*H01T 13/32* (2006.01)
*H01T 13/39* (2006.01)

(52) U.S. Cl.
CPC ..... *H01T 13/32* (2013.01); *H01T 13/39* (2013.01)

(58) Field of Classification Search
CPC ..... H01T 13/32; H01T 13/39
See application file for complete search history.

(56) References Cited

U.S. PATENT DOCUMENTS

| | | | |
|---|---|---|---|
| 1,515,866 | A | 11/1924 | Marten |
| 1,762,989 | A | 6/1930 | Hurley |
| 1,942,242 | A | 1/1934 | Fitzgerald |
| 2,518,844 | A | 8/1950 | Wetzel |
| 2,894,315 | A | 7/1959 | Candelise |
| 4,023,058 | A | 5/1977 | Lara |
| 4,109,633 | A | 8/1978 | Mitsudo et al. |
| 4,970,426 | A | 11/1990 | Bronchart |
| 5,650,687 | A | 7/1997 | Van Den Bogaert |
| 6,170,458 | B1 | 1/2001 | Miller |
| 6,227,164 | B1 | 5/2001 | Miller |
| 6,320,302 | B1 | 11/2001 | Simon |
| 6,326,719 | B1 | 12/2001 | Boehler et al. |
| 6,406,345 | B2 | 6/2002 | Boehler et al. |
| 7,714,489 | B2 | 5/2010 | Torii et al. |
| 7,781,949 | B2 | 8/2010 | Kishimoto et al. |
| 7,906,894 | B2 | 3/2011 | Kameda et al. |
| 8,072,125 | B2 | 12/2011 | Torii et al. |
| 8,125,130 | B2 | 2/2012 | Martin et al. |

(Continued)

FOREIGN PATENT DOCUMENTS

| | | | |
|---|---|---|---|
| CN | 106451081 | A | 2/2017 |
| DE | 102014216403 | A1 | 2/2016 |

(Continued)

*Primary Examiner* — Anne M Hines
(74) *Attorney, Agent, or Firm* — Reising Ethington, P.C.

(57) ABSTRACT

A spark plug having a shell with a ground electrode recess. A ground electrode having an insertion end, a firing end, and a round cross-sectional profile toward the insertion end is inserted into the ground electrode recess of the shell. An attachment portion surrounds at least a portion of the ground electrode and includes a solidified bonding material at a connection interface between the ground electrode and the shell. In some implementations, the ground electrode can have a copper core that extends further into the shell, past the distal end of the insulator. In some embodiments, the ground electrode has a sheath surrounding the copper core that has aluminum and a high weight percentage of nickel.

20 Claims, 2 Drawing Sheets

(56) References Cited

U.S. PATENT DOCUMENTS

| | | | | |
|---|---|---|---|---|
| 8,288,929 | B2 | 10/2012 | Nunome et al. | |
| 8,853,924 | B2 | 10/2014 | Quitmeyer | |
| 8,896,194 | B2 | 11/2014 | Quitmeyer | |
| 9,847,622 | B2 | 12/2017 | Akiyoshi et al. | |
| RE47,073 | E | 10/2018 | Martin et al. | |
| 2002/0011768 | A1* | 1/2002 | Boehler | H01T 13/32 313/141 |
| 2012/0025690 | A1* | 2/2012 | Kohl | H01T 13/32 313/141 |
| 2012/0176020 | A1* | 7/2012 | Quitmeyer | H01T 13/32 313/141 |

FOREIGN PATENT DOCUMENTS

| | | | |
|---|---|---|---|
| EP | 0725463 | A1 | 8/1996 |
| EP | 0859437 | A1 | 8/1998 |
| EP | 1850433 | A1 | 10/2007 |
| GB | 337889 | A | 11/1930 |
| JP | H11121142 | A | 4/1999 |
| JP | 2010251216 | A | 11/2010 |
| JP | 2011233388 | A | 11/2011 |
| JP | 4981746 | B2 | 7/2012 |
| JP | 2013114754 | A | 6/2013 |
| WO | WO2008025476 | A1 | 3/2008 |

* cited by examiner

SPARK PLUG GROUND ELECTRODE CONFIGURATION

FIELD

This disclosure generally relates to spark plugs and other ignition devices for internal combustion engines and, in particular, to ground electrode configurations for spark plugs.

BACKGROUND

Spark plug ground electrodes are primarily responsible for establishing the ground plane for spark initiation within the combustion chamber. Accordingly, the ground electrode must be capable of withstanding temperatures in excess of 900° C., the corrosive environment of combustion by-products, and the mechanical shock of the combustion event itself. Spark plug service life is oftentimes determined by the erosion rate of the precious metal tips on the center and/or ground electrode. Precious metal erosion rates are heavily influenced by the metal temperature while in operation. Reducing the operating temperature of the ground electrode can thereby improve spark plug life.

SUMMARY

According to one embodiment, there is provided a spark plug, comprising: a shell having an axial bore and a ground electrode recess, the ground electrode recess having an abutment surface and a sidewall; an insulator having an axial bore and being disposed at least partially within the axial bore of the shell; a center electrode being disposed at least partially within the axial bore of the insulator; and a ground electrode having an insertion end, a firing end, and a round cross-sectional profile toward the insertion end, wherein the insertion end of the ground electrode is inserted into the ground electrode recess, wherein an attachment portion surrounds at least a portion of the ground electrode, wherein the attachment portion includes a solidified bonding material located at a connection interface at least partially between the ground electrode and the shell.

In accordance with various embodiments, the spark plug may have any one or more of the following features, either singly or in any technically feasible combination:

- the solidified bonding material includes a mixture of material from both the ground electrode and the shell;
- the solidified bonding material is a laser weldment that entirely encircles the ground electrode;
- the solidified bonding material includes a solidified brazing powder;
- the ground electrode includes a taproot section, a curved section, a tapered section, and a firing end section;
- the taproot section includes an overlap region, wherein at the overlap region, a portion of the ground electrode extends toward a terminal end of the spark plug, beyond a distal end of the insulator;
- the firing end section includes a flattened anvil-type tip;
- the firing end section includes a flattened spoon-type tip;
- the tapered section includes a diametrically reduced copper core;
- a copper core extends from the tapered section to the taproot section;
- the sidewall of the ground electrode recess is curved and extends axially straight between the abutment surface and a distal end of the shell;
- the sidewall of the ground electrode recess tapers between the abutment surface and a distal end of the shell;
- the ground electrode has a sheath of a nickel-based material and a copper core of a copper-based material;
- the nickel-based material includes 75-98 wt % nickel and aluminum;
- a diameter of an opening of the ground electrode recess is 85-95% of a thickness of the shell at a distal end of the shell; and/or
- a diameter of the ground electrode at the insertion end is 70-90% of a thickness of the shell at a distal end of the shell.

According to another embodiment, there is provided a spark plug, comprising: a shell having an axial bore and a ground electrode recess, the ground electrode recess having an abutment surface and a sidewall; an insulator having a distal end, a terminal end, and an axial bore that extends between the terminal end and the distal end, the insulator being disposed at least partially within the axial bore of the shell; a center electrode being disposed at least partially within the axial bore of the insulator; and a ground electrode having an insertion end and a firing end, with a taproot section at the insertion end and a firing end section at the firing end, wherein the taproot section includes an overlap region, wherein at the overlap region, a portion of the taproot section extends toward a terminal end of the spark plug, beyond the distal end of the insulator.

According to another embodiment, there is provided a spark plug, comprising: a shell having an axial bore and a ground electrode recess having an abutment surface and a sidewall; an insulator having a distal end, a terminal end, and an axial bore that extends between the terminal end and the distal end, the insulator being disposed at least partially within the axial bore of the shell; a center electrode being disposed at least partially within the axial bore of the insulator; and a ground electrode having an insertion end and a firing end, wherein the insertion end of the ground electrode is inserted into the ground electrode recess, wherein the ground electrode has a sheath of a nickel-based material and a copper core of a copper-based material, wherein the nickel-based material includes 75-98 wt % nickel.

In accordance with various embodiments, the spark plug may have a nickel-based material that includes aluminum and/or a nickel-based material that includes 90-95 wt % nickel and 1-3 wt % aluminum.

DRAWINGS

Preferred embodiments will hereinafter be described in conjunction with the appended drawings, wherein like designations denote like elements, and wherein.

DESCRIPTION

The spark plug and electrode configuration described herein can reduce the ground electrode operating temperature, which can improve the life span of the spark plug. The ground electrode configuration includes a round profile that is particularly attached in the shell to improve heat transfer and provide further extension of the copper core into the thread region. This can reduce operating temperature of the ground electrode firing end by minimizing the surface area exposed to the combustion environment, maximizing the cross-sectional area of a conductive heat transfer path through the copper core, and enhancing the transport of heat directly to the threaded area of the shell where it can then exit to the engine's cylinder head. Additionally, the use of particular material combinations that are described herein can help further encourage heat dissipation away from the firing end of the ground electrode. For example, particular alloys having a high weight percent nickel, along with aluminum, can help promote attachment to the shell, as well as heat transfer up into the shell.

Figure 1:
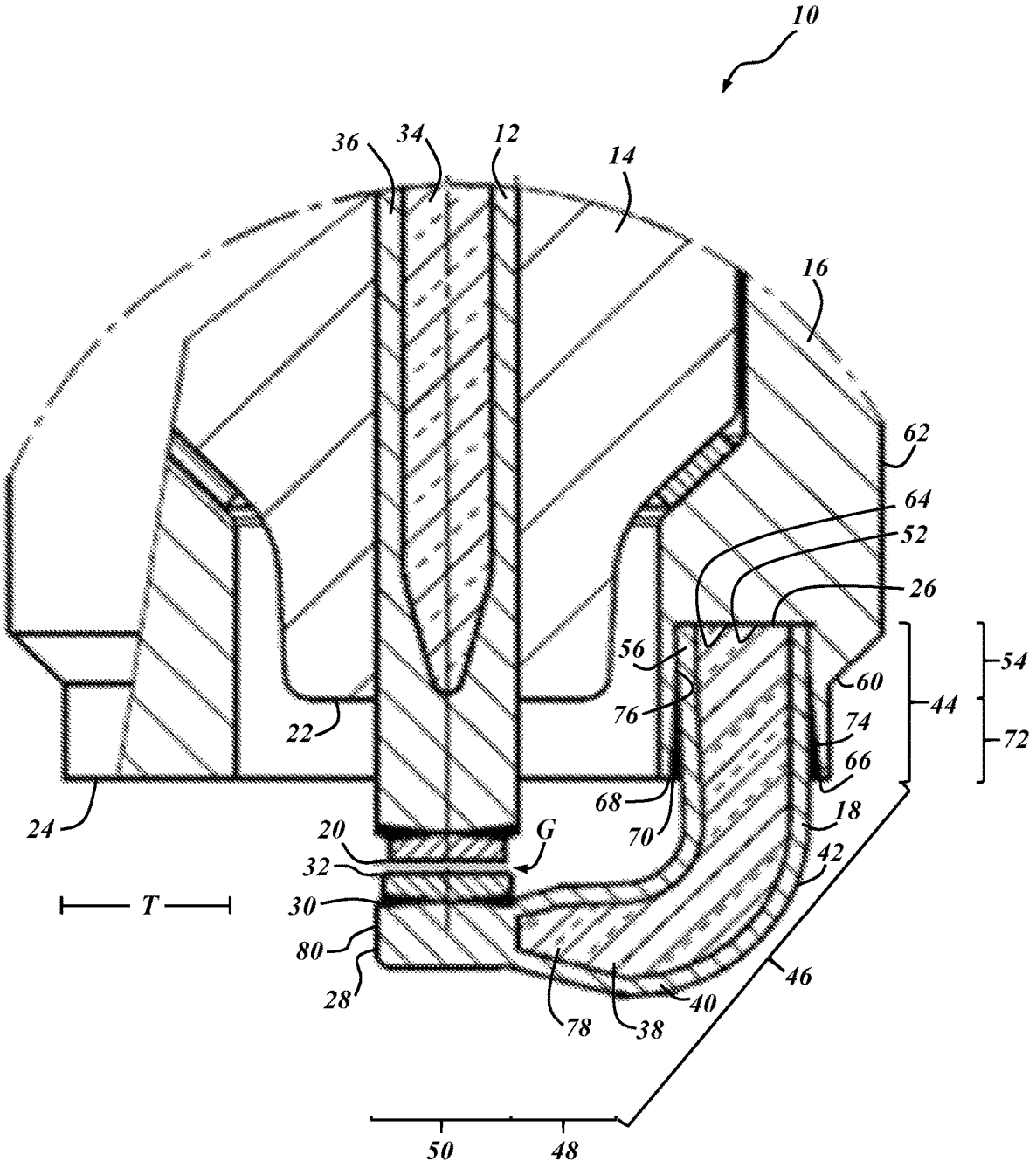
FIG. 1 is a partial, cross-sectional view of a spark plug and ground electrode configuration.

Referring to FIG. 1, there is shown an example spark plug 10 that includes a center electrode 12, an insulator 14, a metallic shell 16, and a ground electrode 18. The center electrode or base electrode member 12 is disposed within an axial bore of the insulator 14 and includes an insulated end and a firing end having a firing tip 20 attached thereto that protrudes beyond a free end or distal end 22 of the insulator 14. The firing tip 20 may be a single- or multi-piece disc, rivet, or other shaped tip that includes a sparking surface and is made from an erosion- and/or corrosion-resistant material. The insulator 14 is disposed within an axial bore of the metallic shell 16 and is constructed from a material, such as a ceramic material, that is sufficient to electrically insulate the center electrode 12 from the metallic shell 16. The free or distal end 22 of the insulator 14 may protrude beyond a free end or distal end 24 of the metallic shell 16, or it may be retracted within the metallic shell 16, as shown. The ground electrode or base electrode member 18 may be constructed according to the conventional L-shape or J-gap configuration shown in the drawings, or according to some other arrangement, and is attached to the distal end 24 of the metallic shell 16. According to this particular embodiment, the ground electrode 18 includes an insertion end 26 and a firing end 28 having a flattened tip portion 30 that opposes the firing tip 20 of the center electrode and has a firing tip 32 attached thereto. The firing tip 32 may be in the form of a flat pad as shown, or any other operable configuration, and includes a sparking surface defining a spark gap G with the center electrode firing tip 20 such that they provide sparking surfaces for the emission and reception of electrons across the spark gap G.

The center electrode 12 and/or the ground electrode 18 may include a core made from a thermally conductive material, such as the core described below, and a cladding or sheath surrounding the core. The core of the center electrode 12 and/or the ground electrode 18 is preferably designed to help conduct heat away from the firing ends of the electrodes towards cooler portions of the spark plug 10. In the embodiment shown in FIG. 1, the center electrode 12 includes a copper core 34 entirely encased within a cladding or sheath 36, and the ground electrode 18 includes a copper core 38 surrounded by a cladding or sheath 40. It should be noted, however, that the thermally conductive cores 34, 38, and/or the center and/or ground electrodes themselves, may take on any of a variety of shapes, sizes and/or configurations other than those shown in the drawings. For example, the center electrode 12 may not include a core in some embodiments. The material of the copper cores 34, 38 may be pure copper, a copper-based alloy, or another thermally conductive material. The copper core 38 of the ground electrode 18 extends from the insertion end 26 toward the firing end 28, and it acts as a heat transfer conduit to help pull heat from the firing end 28 towards the insertion end 26 of the ground electrode 18, and ultimately to the shell 16 and cylinder head.

The sheath 40 is advantageously made from a nickel-based alloy having a high nickel weight percentage, along with the co-addition of aluminum. The nickel weight percentage of the sheath material can be higher than typical ground electrode materials, such as INCONEL™ 600 or INCONEL™ 601, which are oftentimes used for ground electrode sheaths. In some embodiments, these more standard materials could be used; however, the nickel-based alloy described herein can improve attachment of the ground electrode 18 to the shell 16 and help improve heat dissipation away from the firing end 28. In one embodiment, the nickel-based alloy for the sheath 40 includes 75-98 wt % nickel, with the co-addition of aluminum (e.g., about 1-10 wt % with the addition of other minor constituents such as silicon, chromium, iron, manganese, and/or carbon). In an advantageous embodiment, the nickel-based material includes 90-95 wt % nickel, with 1-3 wt % aluminum, along with other minor constituents such as silicon, chromium, iron, manganese, and/or carbon. In yet another advantageously embodiment, the nickel-based alloy for the sheath 40 includes 92.4-94.25 wt % nickel, 1.80-2.20 wt % aluminum, 1.80-2.20 wt % silicon, 1.80-2.20 wt % chromium, 0.35-0.60 wt % manganese, less than or equal to 0.30 wt % iron, and less than or equal to 0.10 wt % carbon. This percentage of nickel, along with the equally proportional co-addition of aluminum, silicon, and chromium, can better promote attachment and heat transfer. In one experiment, this particular nickel-based material resulted in an improved temperature differential of about 60° C. as compared with the same sized and configured ground electrode sheath of INCONEL™ 600. The nickel-based material is preferably, but not necessarily, annealed in a reducing atmosphere to help improve its weldability and potentially minimize cracking during attachment of the ground electrode 18 to the shell 16.

The ground electrode 18 has a round cross-sectional profile 42. The round cross-sectional profile 42 includes the generally cylindrical copper core 38 surrounded by the cylindrical sheath 40. The round cross-sectional profile 42 reduces the temperature of the ground electrode tip 32 by optimizing the ratio of electrode cross-sectional area to surface area. Minimizing the surface area exposed to the combustion environment (e.g., cross-sectional perimeter multiplied by electrode length), minimizes the heat flux into the ground electrode 18. Maximizing the cross-sectional area through the round cross-sectional profile can also maximize the conductive heat transfer path to the spark plug shell 16 and also maximizes the available volume for the material of the core 38. This can be accomplished by having a circular or cylindrical round cross-sectional profile 42.

In the embodiment illustrated in FIG. 1, the ground electrode 18 includes a taproot section 44, a curved section 46, a tapered section 48, and a firing end section 50. The taproot section 44 is fully inserted within a ground electrode recess 52 in the shell 16. The curved section 46 forms the main J-portion of the J-gap. The tapered portion 48 includes a portion of the copper core 38 and a portion of the sheath 40 that are both diametrically reduced as compared with the curved section 46 and the taproot section 44. The firing end section 50 includes the flattened tip portion 30 for accommodating the tip 32. The copper core 38 extends between the tapered section 48, up through the curved section 46, into the taproot section 44. The firing end section 50 in this embodiment is generally comprised of only the material from the sheath 40 without material from the core 38.

Figure 2:
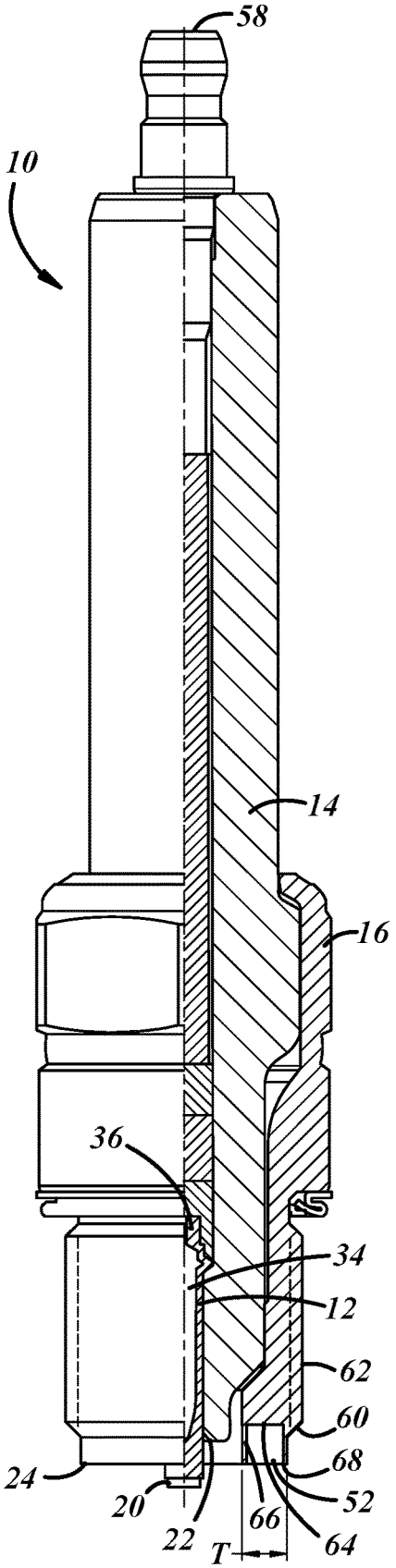
FIG. 2 is a cross-sectional view of a spark plug with the ground electrode removed.

The taproot section 44 of the ground electrode 18 includes an overlap region 54. In the overlap region 54, a portion 56 of the ground electrode 18 extends toward a terminal end 58 (the terminal end 58 is shown in FIG. 2), and extends beyond the distal end 22 of the insulator 14. Many ground electrodes 18 are welded directly to the distal end 24 of the shell 16, or only partially into the shell and not up past the distal end 22 of the insulator 14. Providing an elongated taproot section 44 with the overlap region 54 can help promote heat transfer from the copper core 38 to the cylinder head. Further, having the overlap region 54 fully recessed within a body of the shell 16 can provide additional contact area between the shell 16 and the taproot section 44 further toward the terminal end 58 of the spark plug 10. Additionally, the size of the overlap region 54 generally corresponds to a distance between the insertion end 26 of the ground electrode 18 and an external step 60 in the shell 16. Accordingly, this allows the copper core 38 to reach a threaded area 62 of the shell 16, which is typically closer to the cooling water jacket around the shell. This ground electrode construction approach takes advantage of the improved thermal conductivity properties of copper to enhance the transport of heat directly to the threaded area 62 of the spark plug shell 16 where it can then exit to the cylinder head.

The taproot section 44 is inserted into the ground electrode recess 52 of the shell 16. The ground electrode recess 52 includes an abutment surface 64 and one or more sidewalls 66. Given the round cross-sectional profile of the ground electrode 18, this embodiment includes one cylindrically shaped sidewall 66. The round cross-sectional profile allows for the ground electrode recess 52 to be easily drilled or otherwise machined into the distal end 24 of the shell. The sidewall 66 extends between an opening 68 in the distal end 24 of the shell 16 to the abutment surface 64. The abutment surface 64 is advantageously situated directly against the insertion end 26 of the ground electrode 18, but in some embodiments, there may be some solidified bonding material at least partially located between the abutment surface and the insertion end. Providing a direct connection interface between the abutment surface 64 and the insertion end 26 of the ground electrode 18, as shown, can further promote heat transfer, as such a configuration limits a shell weld land 72 or attachment portion 74 to an area closer to the distal end 24 of the shell 16 without extending into the overlap region 54. The length of the overlap region 54 together with the length of the attachment portion 74, which generally define the length of the taproot section 44, was shown to improve the temperature dissipation by about 45° C. as compared to standard ground electrodes that are welded to the distal end of the shell and did not include the overlap region 54 and attachment portion 74.

Figure 3:
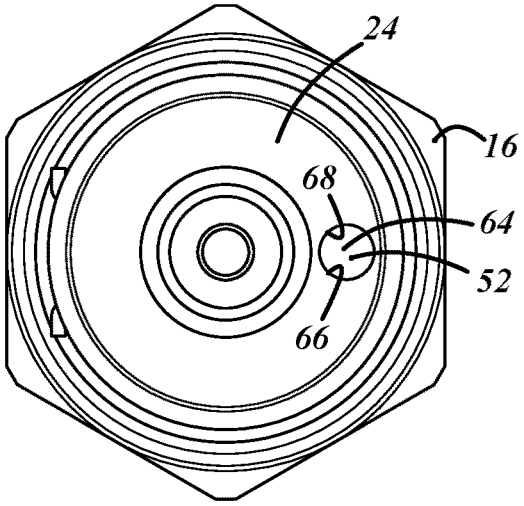
FIG. 3 is an end view of the spark plug shell of FIG. 2.

In the embodiment illustrated in FIG. 1, the sidewall 66 of the ground electrode recess 52 includes a taper 76 such that a diameter of the abutment surface 64 is smaller than a diameter of the opening 68. In the embodiment illustrated in FIGS. 2 and 3, where the ground electrode is removed to more clearly show the ground electrode recess 52, the sidewall 66 extends axially straight between the abutment surface 64 and the opening 68 at the distal end 24 of the shell 16 such that the diameter of the abutment surface and the opening are the same. The taper 76 may be more efficient from a manufacturing standpoint, as it can be easier to insert the ground electrode 18 into the recess 52. The embodiment illustrated in FIGS. 2 and 3, however, with the axially straight sidewall 66, may perform better during operation, as the greater contact area between the taproot section 44 and the ground electrode recess 52 can promote more efficient heat transfer.

The attachment portion 74 serves as the joint or junction between the ground electrode 18 and the ground electrode recess 52. The attachment portion 74 in the embodiment in FIG. 1 is the portion between the distal end 24 of the shell 16 and the overlap portion 54 or the external step 60. The attachment portion 74 includes a solidified bonding material 70 located at least partially between the ground electrode 18 and the shell 16. The attachment portion 74 advantageously extends around the entire circumference of the ground electrode 18, but in some embodiments, may only extend partially around the circumference of the ground electrode. The solidified bonding material 70 of the attachment portion 74 includes a mixture of material from both the ground electrode 18, such as the nickel-based material described above for the sheath 40, and the steel material of the shell 16. This may be accomplished in embodiments where the solidified bonding material 70 is a laser weldment that entirely encircles the round cross-sectional profile 42 of the ground electrode 18. In another embodiment, the solidified bonding material 70 is a solidified brazing powder, such as a nickel-based powder used in a nickel brazing process that is used to attach the ground electrode 18 and the shell 16. Other attachment methods are possible, such as resistance welding, to cite one example. The solidified bonding material 70 generally forms the shell weld land 74, which is advantageously spaced from the insertion end 26 to help reduce the operating temperature of the ground electrode 18 by allowing direct heat transport between the insertion end and the abutment surface 64. With the ground electrode recess 52 shown in FIG. 1 having the taper 76, the shape of the attachment portion 74 may mimic the shape of the taper 76 such that it is wider toward the opening 68 than along other portions of the taproot section 44. Further, it is more likely for the attachment portion 74 to extend into the opening 68 with the taper 76, whereas with an axially straight recess 52, the attachment portion 74 may be situated only at the distal end 24 of the shell 16.

The taproot section 44 and the curved section 46 of the ground electrode 18 have a diameter that is relatively large compared with a thickness T of the shell 16 at the distal end 24. In some embodiments, the diameter of the ground electrode 18 at the taproot section 44 or at the insertion end 26 is about 70-85% of the thickness T of the shell 16. In the illustrated embodiment in FIG. 1, the diameter of the ground electrode 18 at the taproot section 44 or at the insertion end 26 is about 74% of the thickness T of the shell 16. In some embodiments, the diameter of the opening 68 of the ground electrode recess 52 is about 85-95% of the thickness T of the shell 16. In the illustrated embodiment in FIG. 1, the diameter of the opening 68 of the ground electrode recess 52 is about 89% of the thickness T of the shell 16. These ratios help maximize the size of the copper core 38 while maintaining the structural integrity of the shell 16 and attachment portion 74.

The cross-sectional area and size of the copper core 38 is maximized in the taproot section 44 and the curved section 46, but in some embodiments, such as the embodiment illustrated in FIG. 1, the tapered section 48 includes a diametrically reduced copper core portion 78. In the tapered section 48, the diameter of the ground electrode 18 is reduced and the diameter of the copper core 38 is correspondingly reduced. This tapered section 48 may be formed during the firing end section 50 formation process.

Figure 4:
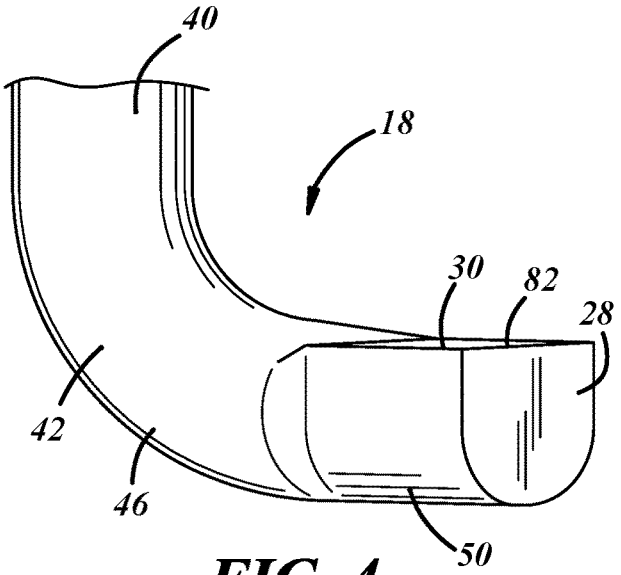
FIG. 4 is a ground electrode configuration according to another embodiment.

The firing end section 50 includes a flattened tip portion 30 in the illustrated embodiments. The flattened tip portion 30 allows for simple attachment of precious metal material, such as the tip 32 to the round ground electrode wire. The manner in which the firing end section 50 is flattened can help maintain the temperature improvements gained from changing the cross-sectional profile 42 from square to round. In the embodiment illustrated in FIG. 1, the firing end section 50 includes an anvil-type tip 80, in which the flattened tip portion 30 is flat on the side of the ground electrode 18 facing the spark gap G, as well as being flat on the side of the ground electrode facing away from the spark gap. In the embodiment illustrated in FIG. 4, the firing end section 50 includes a spoon-type tip 82 in which the flattened tip portion 30 is only flat on the side of the ground electrode facing the spark gap, but is rounded on the side of the ground electrode facing away from the spark gap. Further, in the embodiment of FIG. 4, the ground electrode 18 does not have a tapered portion, but extends directly from the firing end section 50 to the curved section 46. Other structural or configurational adjustments, whether functional or not, are certainly possible.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A spark plug, comprising:

a shell having an axial bore and a ground electrode recess, the ground electrode recess having an abutment surface and a sidewall;

an insulator having an axial bore and being disposed at least partially within the axial bore of the shell;

a center electrode being disposed at least partially within the axial bore of the insulator; and a ground electrode having an insertion end, a taproot section located towards the insertion end, a firing end, and a firing end section located towards the firing end, the taproot section is dimensionally enlarged compared to the firing end section, the insertion end of the ground electrode is inserted into the ground electrode recess so that an attachment portion surrounds at least a portion of the ground electrode, wherein the attachment portion includes a solidified bonding material located at a connection interface at least partially between the ground electrode and the shell.

2. The spark plug of claim 1, wherein the solidified bonding material includes a mixture of material from both the ground electrode and the shell.

3. The spark plug of claim 2, wherein the solidified bonding material is a laser weldment that entirely encircles the ground electrode.

4. The spark plug of claim 1, wherein the solidified bonding material includes a solidified brazing powder.

5. The spark plug of claim 1, wherein the ground electrode includes the taproot section, a curved section, a tapered section, and the firing end section.

6. The spark plug of claim 5, wherein the taproot section includes an overlap region, wherein at the overlap region, a portion of the ground electrode extends toward a terminal end of the spark plug, beyond a distal end of the insulator.

7. The spark plug of claim 5, wherein the firing end section includes a flattened anvil-type tip.

8. The spark plug of claim 5, wherein the firing end section includes a flattened spoon-type tip.

9. The spark plug of claim 5, wherein the tapered section includes a diametrically reduced copper core.

10. The spark plug of claim 5, wherein a copper core extends from the tapered section to the taproot section.

11. The spark plug of claim 1, wherein the sidewall of the ground electrode recess is curved and extends axially straight between the abutment surface and a distal end of the shell.

12. The spark plug of claim 1, wherein the sidewall of the ground electrode recess tapers between the abutment surface and a distal end of the shell.

13. The spark plug of claim 1, wherein the ground electrode has a sheath of a nickel-based material and a copper core of a copper-based material.

14. The spark plug of claim 13, wherein the nickel-based material includes 75-98 wt % nickel and aluminum.

15. The spark plug of claim 1, wherein a diameter of an opening of the ground electrode recess is 85-95% of a thickness of the shell at a distal end of the shell.

16. The spark plug of claim 1, wherein a diameter of the ground electrode at the insertion end is 70-90% of a thickness of the shell at a distal end of the shell.

17. A spark plug, comprising:

a shell having an axial bore and a ground electrode recess with a round cross-sectional profile, the ground electrode recess having an abutment surface and a sidewall;

an insulator having a distal end, a terminal end, and an axial bore that extends between the terminal end and the distal end, the insulator being disposed at least partially within the axial bore of the shell;

a center electrode being disposed at least partially within the axial bore of the insulator; and a ground electrode having an insertion end and a firing end, with a taproot section having a round cross-sectional profile located at the insertion end and a firing end section at the firing end, wherein the taproot section with its round cross-sectional profile inserted into the ground electrode recess with its round cross-sectional profile such that the tap root section includes an overlap region, at which a portion of the taproot section extends toward a terminal end of the spark plug, beyond the distal end of the insulator.

18. A spark plug, comprising:

a shell having an axial bore and a ground electrode recess having an abutment surface that is flat and a sidewall;

an insulator having a distal end, a terminal end, and an axial bore that extends between the terminal end and the distal end, the insulator being disposed at least partially within the axial bore of the shell;

a center electrode being disposed at least partially within the axial bore of the insulator; and a ground electrode having an insertion end, a firing end, a sheath, and a copper core, the insertion end of the ground electrode is flat and is inserted into the ground electrode recess such that the copper core contacts the flat abutment surface of the ground electrode recess, the sheath includes a nickel-based material and the copper core includes a copper-based material, wherein the nickel-based material includes 75-98 wt % nickel.

19. The spark plug of claim 18, wherein the nickel-based material includes aluminum.

20. The spark plug of claim 19, wherein the nickel-based material includes 90-95 wt % nickel and 1-3 wt % aluminum.

* * * * *